US005607571A

United States Patent [19]

Franz et al.

[11] Patent Number: 5,607,571

[45] Date of Patent: Mar. 4, 1997

[54] ELECTROCHEMICAL PROCESS FOR PREPARING LOW-CHLORIDE AQUEOUS TITANYL NITRATE SOLUTIONS

[75] Inventors: Klaus-Dieter Franz, Kelkheim; Manfred Parusel, Munster; Mathias Schraml-Marth, Zwingenberg; Klaus-Michael Juttner, Altenstadt; Sabine Schafer, Frankfurt am Main, all of Germany

[73] Assignee: Merck Patent Gesellschaft Mit Beschrankter Haftung, Darmstadt, Germany

[21] Appl. No.: 409,724

[22] Filed: Mar. 24, 1995

[30] Foreign Application Priority Data

Mar. 26, 1994 [DE] Germany ..... 44 10 581.9

[51] Int. Cl.[6] ..... C25B 1/00

[52] U.S. Cl. ..... 205/493; 432/29; 432/1

[58] Field of Search ..... 204/86, 91, 128, 204/129; 205/493; 432/29, 1; C25B 1/00

[56] References Cited

U.S. PATENT DOCUMENTS 4,995,950 2/1991 Kochanek et al. ..... 204/91

*Primary Examiner*—Kathryn Gorgos

*Attorney, Agent, or Firm*—Millen, White, Zelano, & Branigan, P.C.

[57] ABSTRACT

An electrochemical process for preparing low-chloride aqueous solutions of titanyl nitrate which have a low chloride content, particularly, less than 200 ppm.

15 Claims, No Drawings

ELECTROCHEMICAL PROCESS FOR PREPARING LOW-CHLORIDE AQUEOUS TITANYL NITRATE SOLUTIONS

The invention relates to an electrochemical process for preparing low-chloride aqueous solutions of titanyl nitrate (titanium oxide nitrate, $TiO(NO_3)_2$) having a low chloride content, particularly less than 200 ppm.

BACKGROUND OF THE INVENTION

Soluble titanium compounds are of great importance in chemistry and related technical fields. For example, they can be used as versatile reagents in chemical synthesis and analysis. Furthermore, of particular importance is the use of these compounds for the precipitation of titanium dioxide in or from solutions, for example in the form of sols or gels, of finely divided powders, as thin coatings on any substrates, for example on glass for optical or decorative purposes or in the preparation of pearl luster pigments based on mica coated with $TiO_2$. In the high-performance ceramics sector, the element titanium plays a widespread and often essential role in functional ceramics, in particular in electroceramics and piezo-ceramics For the above applications, titanyl nitrate or aqueous titanyl nitrate solution is the preferred titanium source.

Other soluble or liquid titanium compounds such as titanyl sulphate ($TiOSO_4$), titanium tetrachloride and titanyl chloride ($TiOCl_2$) are unsuitable as such for ceramic purposes. Organic titanium compounds such as, for example, orthotitanates are expensive. All these compounds have in common that owing to their high sensitivity to hydrolysis they are very unstable and difficult to handle.

The key substance as a source for virtually all significant titanium compounds is titanium tetrachloride, which is prepared from titanium dioxide. The latter is in turn extracted from naturally occurring minerals.

Astonishingly, the relevant technical literature gives hardly any directions for a preparation of titanyl nitrate or its aqueous solution which is practical and can be readily carried out on an industrial scale.

Theoretically, it should be possible to prepare titanyl nitrate in aqueous solution from titanium tetrachloride or its partial hydrolysis product titanyl chloride by reaction with nitric acid in accordance with the equations $$TiCl_4+2HNO_3+H_2O \rightarrow TiO(NO_3)_2+4HCl$$

or $$TiOCl_2+2HNO_3 \rightarrow TiO(NO_3)_2+2HCl$$

In practice, however, reactions based on these equations do not provide the desired objective, since at least partial hydrolysis, usually during the reaction, occurs precipitating $TiO_2$ and/or $TiO_2$ hydrogels. A complete redissolution of titanium dioxide or the $TiO_2$ hydrogels once precipitated is not possible in practice. Furthermore, it is not possible to completely remove the hydrochloric acid formed in the reaction from the reaction solution. Attempts to drive off the hydrochloric acid, for example by heating or passing through inert gas, remain incomplete and likewise lead to precipitation of $TiO_2$. Precipitation as silver chloride, which is conceivable in principle, is impractical for economic reasons, even for relatively low residual chloride contents.

The presence of chloride is extremely undesirable in high-temperature solid-state reactions such as the sintering of ceramics or the calcination of $TiO_2$ coatings. Metal chlorides are known to be very volatile at high temperatures. Even very small amounts of chloride in ceramic compositions for high-performance ceramics, therefore, result in composition changes during sintering with, for example, the content of dopants changing dramatically.

An acceptable limit for a residual chloride content in a titanyl nitrate solution which is tolerable for the above objectives can be regarded as about 200 ppm, based on titanyl nitrate.

DE 41 10 685 A1 describes a process for preparing low-chloride aqueous solutions of titanyl nitrate by reaction of titanium tetrachloride or titanyl chloride with nitric acid, wherein the reaction is carried out in the presence of excess nitric acid and/or hydrogen peroxide, by which means the chloride present is oxidized to chlorine and the product obtained has a residual chloride content of less than 200 ppm.

However, this process, which leads to an excellent result per se, has some disadvantages which become unpleasantly noticeable when the reaction is carried out in practice and, in particular, in industry. On the one hand, this process requires the handling of concentrated, in particular, fuming, nitric acid, and highly concentrated hydrogen peroxide. These chemicals are known to be extremely dangerous. Transport, storage and use require very strict safety measures. On the other hand, the reaction forms, apart from chlorine gas, relatively large amounts of nitrous gases which have to be trapped and rendered harmless. Furthermore, the end point of the reaction at which the desirably low chloride content is reached is difficult to determine unless undesirably large excesses of nitric acid or hydrogen peroxide are used.

SUMMARY OF THE INVENTION

An object of the invention, therefore, is to provide a process for preparing low-chloride content aqueous solutions of titanyl nitrate while avoiding the problems of the known processes.

Upon further study of the specification and appended claims, further objects and advantages of this invention will become apparent to those skilled in the art.

It has now been found that low-chloride aqueous solutions of titanyl nitrate can be obtained if titanium tetrachloride and/or titanyl chloride is subjected to electrolysis in the presence of nitric acid, particularly when the electrolysis is conducted such that the potential of the anode is from 1.1 to 1.7 volts relative to a saturated Ag/AgCl reference electrode.

The invention accordingly provides a process for preparing low-chloride aqueous solutions of titanyl nitrate, in which titanium tetrachloride and/or titanyl chloride is subjected to electrolysis in the presence of nitric acid, preferably at electrode potentials from 1.1 to 1.7 volts, giving a product having a low residual chloride content, preferably less than 200 ppm.

The process of the invention is, depending on the titanium compounds used, based on the following reactions:

$$TiCl_4+2HNO_3+H_2O \leftrightarrows TiO(NO_3)_24+H^++4Cl^- \quad \text{(Ia)}$$

$$\text{Anode reaction: } 4Cl^- \rightarrow 2Cl_2\uparrow+4e^- \quad \text{(Ib)}$$

$$\text{Cathode reaction: } 4H^++4e^- \rightarrow 2H_2\uparrow \quad \text{(Ic)}$$

$$TiOCl_2+2HNO_3 \leftrightarrows TiO(NO_3)_2+2H^++2Cl^-+tm \quad \text{(IIa)}$$

$$\text{Anode reaction: } 2Cl^- \rightarrow Cl_2\uparrow+2e^- \quad \text{(IIb)}$$

Cathode reaction: $2H^+ + 2e^- \rightarrow H_2\uparrow$ (IIc)

The reaction equilibria (Ia) and (IIa) of the actual chemical reaction are shifted to the right by the anode reaction (Ib) or (IIb) and the cathode reaction (Ic) or (IIc), i.e., towards the formation of titanyl nitrate.

The only other reaction products obtained are chlorine gas and hydrogen gas, which are comparatively simple to handle and to dispose of. It has been found that the above reactions proceed without difficulty and without formation of undesired products or byproducts such as, in particular, nitrous gases; particularly, if during the electrolysis, the potential of the anode is potentiostatically set to values in the range from 1.1 to 1.7 volts. The electrolysis is preferably carried out in the potential range from 1.2 to 1.6 volts, with adherence to a constant potential of 1.4 volts having been found to be particularly favorable.

A particular operational advantage of the process of the invention is that it can be carried out using dilute or at most moderately concentrated nitric acid. Hydrogen peroxide can be dispensed with entirely.

Owing to the development of chlorine gas at the anode and hydrogen gas at the cathode, which gases can together form explosive mixtures, it is advantageous to separate the anode space and the cathode space by means of a membrane and to provide for the separate removal of the gases by conventional means. The anode space may be charged with an aqueous mixture of titanium tetrachloride and/or titanyl chloride and nitric acid and the cathode space advantageously contains an aqueous nitric acid solution. In the solution mixture of the anode space, the molar ratio of titanium tetrachloride or titanyl chloride to nitric acid may preferably be from 1:2 to 1:5. Titanium tetrachloride or titanyl chloride are here preferably used in the form of 20 to 50% aqueous solutions. Particular preference is given to the use of a 30% aqueous solution. The nitric acid to be mixed in can preferably have a concentration of from 30 to 70% by weight, particularly preferably 65% by weight. The cathode space is charged with preferably 5–25%, particularly preferably 10%, aqueous nitric acid.

The process of the invention can be carried out in an extremely simple manner and without a major outlay for equipment. The process can also be carried out without problems, in particular, on a pilot plant scale and on an industrial production scale. Electrolysis equipment and techniques which are conventional and known per se can be used. Suitable in principle are electrolysis cells having volumes corresponding to the desired production amount and made of inert material, for example glass, ceramic or resistant plastics such as, for example, polytetrafluoroethylene. The cells are preferably provided with devices for conducting away the reaction gases and can advantageously be provided with inlet and outlet facilities for the solutions and also with stirring or mixing devices. Suitable materials for the electrodes are those which are inert to the solutions used under the particular electrolysis conditions. Thus, for example, electrodes of platinum or titanium are well suited. Their dimensions and shape can be selected as desired and depend expediently on the size and configuration of the electrolysis cells. Membranes which can be used for separating the electrode spaces can be, for example, porous glass or ceramic materials or permeable plastic membranes, for example of polytetrafluoroethylene.

The process is carried out by, after charging the electrolysis apparatus with the appropriate solutions, applying a voltage lying within the specified range and continuing the electrolysis until complete conversion has been achieved, which can be roughly determined by the cessation of gas evolution. The process may also be adapted for continuous operation. The potential of the anode can advantageously be regulated at a fixed value, for instance 1.4 volts, by means of a conventional potentiostat. The progress of the reaction can be monitored by means of conventional measurement techniques using the current-potential curve. For these measurements, the apparatus can be equipped with the reference electrodes and instruments required for this purpose. When the current flow reaches a minimum value, the reaction is complete. The chloride ion concentration in the reaction solution of the anode space can be determined by sampling and ion chromatography of the sample. The duration of electrolysis depends essentially on the amount of reaction solution, the size and capability of the apparatus and on the current maintained.

In typical semi-technical experiments, i.e., technical laboratory scale, using an initial potential of 1.2 volts and an initial current of 1 ampere, a final current of 0.09 ampere was measured after about 13 hours at a final potential of 1.4 volts. The residual chloride ion concentration in the reaction solution was 0.0009 mol/l.

Using the electrochemical process of the invention, it is possible to obtain in every case reaction solutions having a low residual chloride content, particularly of less than 200 ppm, based on the titanyl nitrate content. In general, residual contents of from 100 to 10 ppm or even less are achieved. The process is thus very well suited to the preparation of low-chloride aqueous solutions of titanyl nitrate.

In the foregoing and in the following examples, all temperatures are set forth uncorrected in degrees Celsius; and, unless otherwise indicated, all parts and percentages are by weight.

The entire disclosure of all applications, patents and publications, cited above and below, and of corresponding P 44 10 581.9, filed Mar. 26, 1994, are hereby incorporated by reference.

EXAMPLES

Example 1

The electrolysis apparatus used was a divided cell. It consisted of two cylindrical half cells in a double wall configuration having an external diameter of 12 cm; the half cells being separated from one another by a polytetrafluoroethylene (TEFLON®) membrane. The electrodes in the anode and cathode spaces consisted of circular coated expanded-metal titanium discs having a diameter of 7 cm and an area of 35 $cm^2$.

The reaction was carried out under potentiostatic conditions. For this purpose, the potential of the titanium working electrode in the anode space was measured using an Ag/AgCl, KCl (saturated) reference electrode, configured as a Haber-Luggin capillary.

At the beginning of the experiments, the anode space of the measurement cell was charged with an electrolyte composition containing 36 ml of 65% $HNO_3$+50 ml of 30% $TiCl_4$. This corresponds to a molar ratio $TiCl_4$: $HNO_3$ of 1:5.

For the cathode space, a 10% $HNO_3$ solution was used. The gases $Cl_2$ and $H_2$ formed during the reaction in the anode and cathode spaces were conducted away separately. $Cl_2$ was absorbed in NaOH. $H_2$ was vented outside via the extraction.

The reactions were carried out at room temperature.

The potential of the working electrode was set potentiostatically to an initial value of 1.2 V. The initial current of 1 A dropped to 0.09 A over the course of 13 hours with decreasing $Cl^-$ concentration. The potential was manually adjusted from time to time until a maximum final value of 1.4 V was reached.

After an experiment duration of 13 hours, the anode space had a residual chloride content of 0.0009 mol/l, which corresponds to a concentration of 158 ppm based on $TiO(NO_3)_2$.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process comprising subjecting titanium tetrachloride, titanyl chloride or a mixture thereof to electrolysis in nitric acid, wherein a titanyl nitrate solution having a residual chloride content of less than 200 ppm is formed.

2. The process of claim 1, wherein the electrolysis is conducted with an anode potential of from 1.1 to 1.7 volts.

3. The process of claim 2, wherein no nitrous gases are formed by the electrolysis.

4. The process according to claim 1, wherein the electrolysis is carried out in an electrolysis apparatus having an anode space and a cathode space which are separated by a membrane, with the anode space containing an aqueous mixture of titanium tetrachloride, titanyl chloride or a mixture thereof and nitric acid and the cathode space containing an aqueous solution of nitric acid.

5. The process according to claim 4, wherein the anode space contains titanium tetrachloride, titanyl chloride or a mixture thereof and nitric acid in a molar ratio of the combination of titanium tetrachloride and titanyl chloride to nitric acid from 1:2 to 1:5.

6. The process according to claim 5, wherein the mixture used for the anode space is a mixture of 20–50% aqueous titanium tetrachloride, titanyl chloride or a mixture thereof in solution and 30–70% aqueous nitric acid and the solution used for the cathode space is 5–25% aqueous nitric acid.

7. The process according to claim 4, wherein the mixture used for the anode space is a mixture of 20–50% aqueous titanium tetrachloride, titanyl chloride or a mixture thereof in solution and 30–70% aqueous nitric acid and the solution used for the cathode space is 5–25% aqueous nitric acid.

8. The process according to claim 4, wherein the electrolysis is carried out at an anode potential of from 1.2 to 1.6 volts.

9. The process according to claim 4, wherein the electrolysis is carried out at an anode potential of about 1.4 volts.

10. The process of claim 4, wherein chlorine gas is removed from above the anode space and hydrogen gas is separately removed from above the cathode space.

11. The process of claim 4, wherein the membrane is a membrane or porous glass or ceramic material or a permeable plastic membrane.

12. The process according to claim 1, wherein the electrolysis is carried out at an anode potential of from 1.2 to 1.6 volts.

13. The process according to claim 1, wherein the electrolysis is carried out at an anode potential about 1.4 volts.

14. The process of claim 1, wherein the titanyl nitrate solution product has a residual chloride content of 10 to 100 ppm.

15. The process of claim 1, further comprising sintering a titanium-containing material obtained from the titanyl nitrate solution to produce a ceramic.

* * * * *